United States Patent [19]

Leake

[11] Patent Number: 4,502,028

[45] Date of Patent: Feb. 26, 1985

[54] PROGRAMMABLE TWO-PORT MICROWAVE NETWORK

[75] Inventor: Bernard W. Leake, Framingham, Mass.

[73] Assignee: Raytheon Company, Lexington, Mass.

[21] Appl. No.: 388,781

[22] Filed: Jun. 15, 1982

[51] Int. Cl.[3] ..... H01P 5/18

[52] U.S. Cl. ..... 333/109; 324/58 R; 333/245; 333/262; 333/99 R

[58] Field of Search ..... 324/58 R; 333/100, 101, 333/109, 117, 245, 99 R

[56] References Cited

U.S. PATENT DOCUMENTS

| | | | |
|---|---|---|---|
| 3,559,108 | 1/1971 | Seidel | 333/109 X |
| 3,611,199 | 10/1971 | Safran | 333/109 |
| 4,016,516 | 4/1977 | Sauter et al. | 333/109 X |
| 4,104,583 | 8/1978 | Engen | 324/58 R X |
| 4,442,416 | 4/1984 | Epsom et al. | 333/109 X |

*Primary Examiner*—Paul Gensler

*Attorney, Agent, or Firm*—Walter F. Dawson; Richard M. Sharkansky; Joseph D. Pannone

[57] ABSTRACT

An adjustable two-port microwave network having digitally controlled switches which enable the network to be set to a plurality reflection and transmission coefficients. The network facilitates the collection of a plurality of measurements which are necessary to characterize a non-linear device. An embodiment of the network is constructed using a 3dB directional coupler feeding two identical power divider networks each comprising two cascaded directional couplers. One divider network is connected directly to the coupled port of the 3dB directional coupler and the other divider network is connected through a phase shifter to the output port of the 3dB directional coupler. The non-linear device to be characterized is connected to the input port of the 3dB directional coupler and for this application, the isolated port is terminated in its characteristic impedance.

51 Claims, 5 Drawing Figures

PROGRAMMABLE TWO-PORT MICROWAVE NETWORK

BACKGROUND OF THE INVENTION

This invention aids the characterization of microwave devices and circuits and more particularly relates to a digitally controlled microwave impedance network for producing a plurality of complex impedances.

The characterization of microwave devices and circuits is often accomplished by terminating the device in a network consisting of a combination of existing components such as variable tuners, attenuators and phase shifters which must be calibrated together and provided with some means of resetting their adjustments to the previously calibrated position; such adjustments are usually continuous. For high power applications, some of the readily available components are unsuitable because of their power sensitivity or limitations. The characterization of non-linear power transistors and low noise linear transistors both require measurements to be made under various loading conditions. Computer control of these measurements is attractive not only from the point of view of data collection and manipulation, but also in the equipment control that it provides.

There are two essentially different approaches to the characterization of load dependent devices. One is to adjust the load until some performance criteria are met; the other is to measure the performance for various known loading conditions and then establish their relationships. This second method is better suited to digital control because it requires a finite number of discrete states of loads (which can be calibrated) rather than continuous variability.

SUMMARY OF THE INVENTION

This invention discloses a programmable two-port microwave network including a four-port reciprocal coupling means for dividing an input signal into two isolated output signals, means for providing a phase shift to a first one of the output signals, means coupled to a second one of said output signals for producing in response to a control signal a selected one of a plurality of reflections comprising discrete amplitudes with similar phases, and means for generating the control signal with digital control for selection any one of a plurality of discrete reflection and transmission coefficients of the input signal. A 3 dB directional coupler is used to divide the input signal into two isolated output signals. A plurality of directional couplers and switches combine to produce a plurality of reflections comprising different discrete amplitudes with similar phase. A programmable digital controller is used to select any one of the plurality of discrete reflection and transmission coefficients of the input signal. When the network is used to terminate a device under test, the isolated port of the 3 dB directional coupler is terminated with its characteristic impedance, and a plurality of discrete reflection coefficients are presented to said device.

The invention further discloses reciprocal coupling means for dividing an input signal into two isolated output signals, first network means for producing reflections of different discrete amplitudes with similar phase at the input of the coupling means, second network means for producing reflections of different discrete amplitudes with similar phase at the input of the coupling means, means for controlling the relative phase of the reflections at the input to the coupling means produced by the first network means and the second network means, and digital control means for selecting a plurality of reflection and transmission coefficients of the input signal. A 3 dB directional coupler is used to divide the input signal into two isolated output signals. The means for controlling the relative phase is selected to make the reflections at the input of the input coupling means, produced by the first network means, be in phase quadrature with the reflections produced by the second network means at the input of the input coupling means. The means for controlling the relative phase results in the signals from an isolated port of the reciprocal coupling means, produced by the first and second network means, being in phase quadrature. The first network means and the second network means each comprises a power divider with a plurality of mutually isolated outputs. Each power divider network comprises at least one directional coupler and a switch at each output of the networks.

The invention further discloses the method of generating a plurality of reflection and transmission coefficients comprising the steps of dividing an input signal into two isolated output signals with a reciprocal coupling means, producing reflections of different discrete amplitudes with similar phase at the input of said coupling means with a first network means, producing reflections of different discrete amplitudes with similar phase at the input of the coupling means with a second network means, controlling the relative phase of the reflections at the input to the coupling means produced by the first network means and the second network means, and selecting a plurality of reflections and transmission coefficients of the input signal with digital control means. The step of dividing an input signal into two isolated output signals comprises a 3 dB directional coupler. The step of controlling the relative phase comprises making the reflection at the input of the coupling means, produced by the first network means, be in phase quadrature with the reflections produced by the second network means at the input of the coupling means. The step of controlling the relative phase results in the signals from an isolated port of the reciprocal coupling means produced by the first and second network means being in phase quadrature. The step of producing reflections of different discrete amplitudes with the first network means comprises using a power divider with a plurality of mutually isolated outputs each connected to a two-state switch. The step of producing reflections of different discrete amplitudes with the second network means also comprises using a power divider with a plurality of mutually isolated outputs each connected to a two-state switch.

BRIEF DESCRIPTION OF THE DRAWINGS

Other and further features and advantages of the invention will become apparent in connection with the accompanying drawings wherein.

DESCRIPTION OF THE PREFERRED EMBODIMENT

Figure 1:
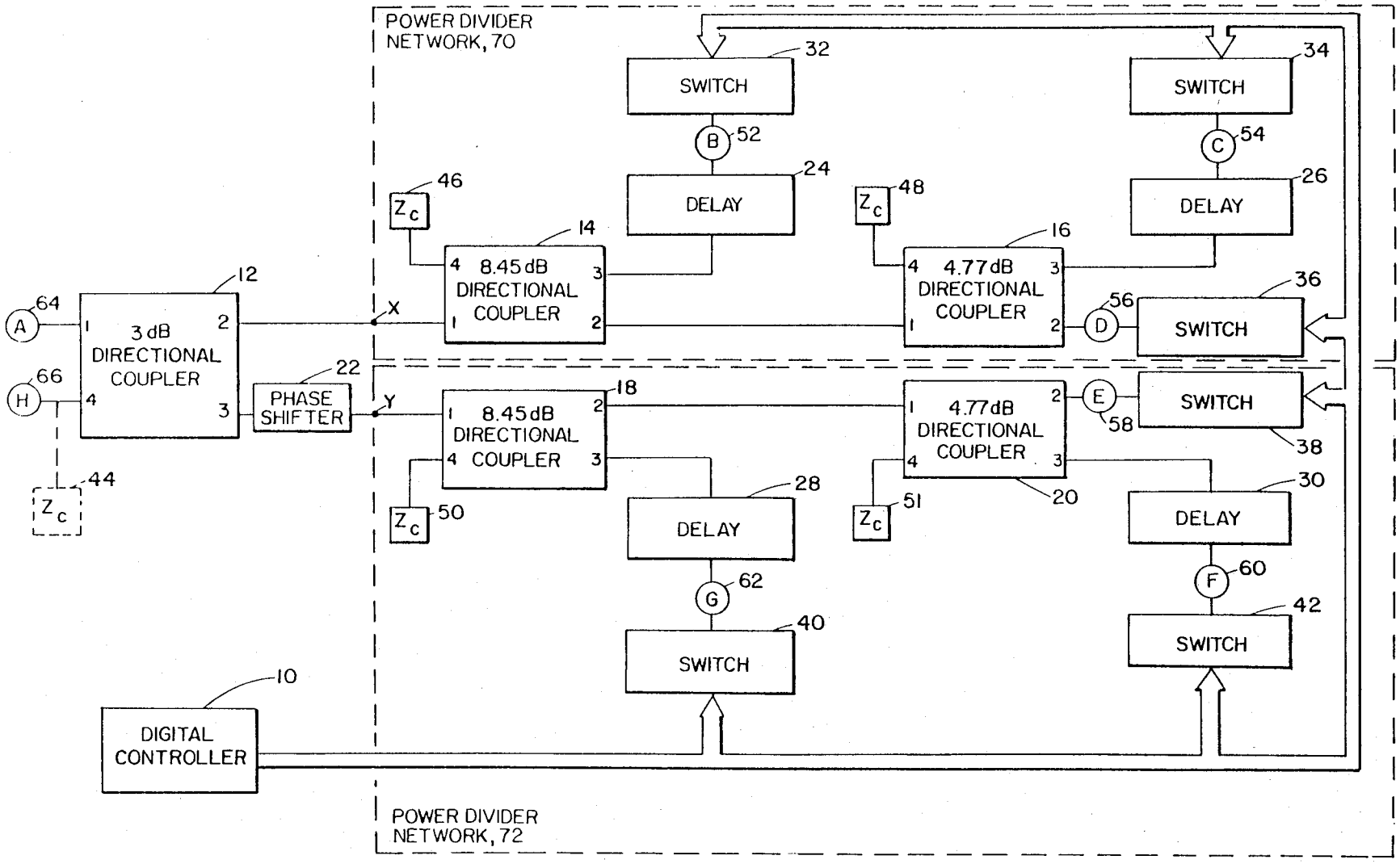
FIG. 1 is a functional block diagram of a programmable two-port microwave network embodiment according to the invention.

Referring now to FIG. 1, there is shown a block diagram of a programmable two-port microwave network. Input port A 64 provides the connection to a device under test and presents sixty-four discrete impedances to said device when port H 66 is terminated in its characteristic impedance Zc 44. There are six other ports, B, C, D, E, F and G 52 to 62 which are terminated in either open or short-circuits independently switched by a digital controller 10 in order to provide said discrete impedances at port A 64. The digital controller 10 comprises a programmable digital computer with interface circuitry readily known to one skilled in the art.

Figure 2:
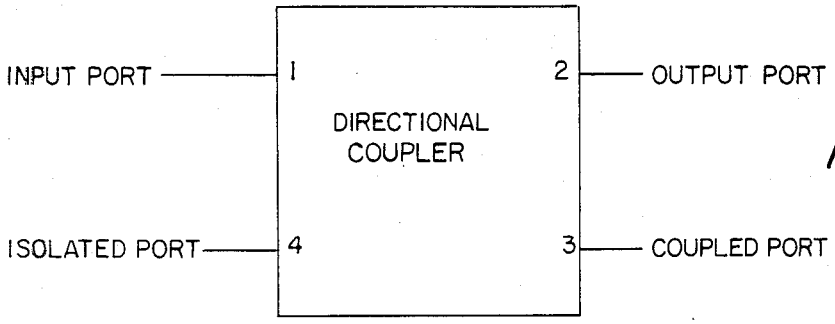
FIG. 2 depicts a directional coupler block diagram representation with a description of each port.

Port A 64, as shown in FIG. 1, connects to input port 1 of 3 dB directional coupler 12. FIG. 2 shows a functional block used to identify a directional coupler with its four terminals described in the conventional manner of input port 1, output port 2, coupled port 3 and isolated port 4. When used to terminate a device under test, isolated port 4 of said 3 dB directional coupler 12 is terminated with its characteristic impedance Zc 44. Output port 2 of directional coupler 12 connects to power divider network 70 and coupled port 3 connects to a phase shifter 22. The output of phase shifter 22 connects to power divider network 72 which is identical to power divider network 70. The 3 dB directional coupler 12 divides an input signal at port 1 equally between its coupled port 3 and output port 2. The phase shifter 22 provides a 45° phase shift so that, if the reflection magnitudes at points X and Y are X and Y, then the reflections at port A 64 combine to form $(X+jY)/2$. The factor $\frac{1}{2}$ is caused by the 3 dB directional coupler. The phase shifter 22 is selected to make the phase shift from port 3 of the 3 dB directional coupler 12 to port 1 of the 8.45 dB directional coupler 18 45° longer than the phase shift from port 2 of said 3 dB coupler 12 to port 1 of an 8.45 dB directional coupler 14.

Still referring to FIG. 1, the output port 2 of 3 dB directional coupler 12 connects to input port 1 of an 8.45 dB directional coupler 14 within power divider network 70; isolated port 4 is terminated with a resistive load equal to the coupler's characteristic impedance Zc 46 and coupled port 3 connects to delay 24 which connects to port B 52. The delay 24 is selected to make the electrical length from port 1 of the 8.45 dB directional coupler 14 to switch 32 the same as the electrical length from said port 1 to switch 34. Output port 2 of the 8.45 dB directional coupler 14 connects to input port 1 of a 4.77 dB directional coupler 16. The 8.45 dB directional coupler 14 provides a division of the input power at its port 1 such that 1/7 of said input power is transferred to coupled port 3 and 6/7 of said input power is transferred to output port 2. Port B 52 is connected to switch 32 which provides either an open circuit or a short circuit and it is under the program control of a digital controller 10 as are the other switches 34 to 40. Said digital controller comprises a programmable digital computer and it is known to one skilled in the art. The 4.77 dB directional coupler 16 provides a division of the input power at port 1 such that $\frac{1}{3}$ of said power is transferred to coupled port 3 and $\frac{2}{3}$ of said input power is transferred to output port 2; isolated port 4 is terminated with a resistive load equal to the characteristic impedance Zc 48. The coupled port 3 connects to port C 54 via delay 26. Port C 54 connects to switch 34. Output port 2 connects to port D 56 which connects to switch 36. The delay 26 is selected to make the electrical length from port 1 of the 4.77 dB directional coupler 16 to switch 34 the same as the electrical length from said port 1 to switch 36.

The power divider network 72 as shown in FIG. 1 of the preferred embodiment is identical to power divider network 70. The output from phase shifter 22 is connected to the input port 1 of an 8.45 dB directional coupler 18; isolated port 4 is terminated with a resistive load equal to the couplers charactertistic impedance Zc 50. Coupled port 3 connects to delay 28 the output of which connects to port G 62. The delay 28 is selected to make the electrical length from port 1 of the 8.45 dB directional coupler 18 to switch 40 the same as the electrical length from said port 1 to switch 42. Output port 2 of the 8.45 dB directional coupler 18 connects to input port 1 of a 4.77 dB directional coupler 20. The 8.45 dB directional coupler 18 provides a division of the input power at port 1 such that 1/7 of said input power is transferred to coupled port 3 and 6/7 of said input power is transferred to output port 2. Port G 62 is connected to switch 40 which provides either an open circuit or a short circuit and it is under the program control of digital controller 10 as are the other switches 32 to 40.

The 4.77 dB directional coupler 20 provides a division of the input power at port 1 such that $\frac{1}{3}$ of said power is transferred to coupled port 3 and $\frac{2}{3}$ of said input power is transferred to output port 2; isolated port 4 is terminated with a resistive load equal to the characteristic impedance Zc 51. The coupled port 3 connects to port F 60 via delay 30. Port F 60 connects to switch 42. Output port 2 connects to port E 58 which connects to switch 38. The delay 30 is selected to make the electrical length from port 1 of the 4.77 dB directional coupler 20 to switch 42 the same as the electrical length from said port 1 to switch 38.

Figure 3:
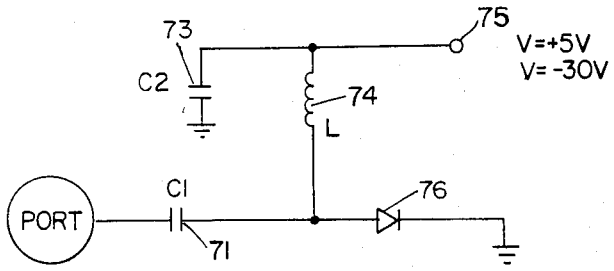
FIG. 3 shows a PIN diode switch with associated DC biasing related components.

Referring now to FIG. 3, each one of the switches 32 to 40 comprises a switchable PIN diode 76 with cathodes connected to ground. The letters PIN denote heavily P doped semiconductor material, heavily N doped semiconductor material and an intervening undoped intrinsic (I) layer in which charge is stored. PIN diodes have low capacitance and very high impedance when reversed-bias and can also withstand large RF voltages. The PIN diode 76 effectively acts as an open circuit or a short circuit to an RF signal depending on the biasing of said diode. No intermediate state of the PIN diode 76 is necessary or desirable. When +5 V is applied to terminal 75, the pin diode is forward biased and acts as a short circuit. When −30 V is applied to terminal 75, the PIN diode is reversed-biased and acts on an open circuit. The application of the voltage biases to terminal 75 is controlled by digital controller 10 as shown in FIG. 1. An inductor L 74 blocks the RF signal from escaping through the DC bias path and capacitor C1 71 is a DC block which facilitates maintaining a proper bias on PIN diode 76. Capacitor C2 73 is an RF bypass capacitor to ground.

Figure 4:
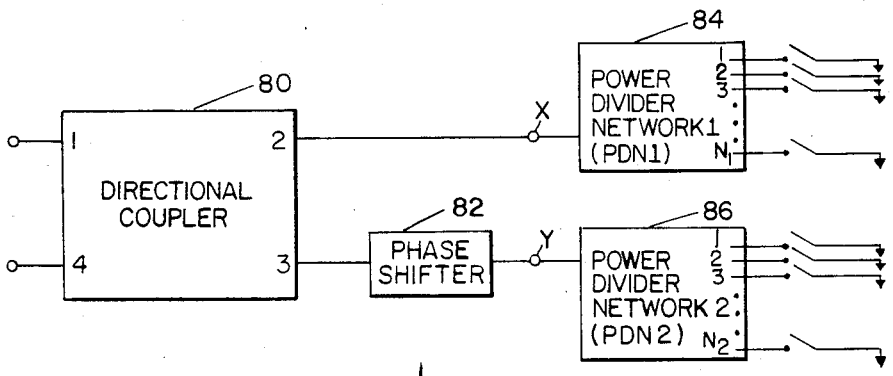
FIG. 4 is a block diagram of the general case of a programmable two-port microwave network.

Referring now to FIG. 4, there is shown a block diagram of the general case of a digitally controlled two port impendance microwave network. Directional coupler 80 divides a signal incident at port 1 between ports 2 and 3 with (ideally) no loss. Ports 1 and 4 are isolated from each other as are ports 2 and 3. Phase shifter 82 is a fixed lossless phase element which causes the reflected signals at port 1 of directional coupler 80, produced by similar reflectors at points X and Y, to be in phase quadrature. This phase shifter 82 may be omitted if its function is included in the design of directional coupler 80 such that the divided outputs from ports 2 and 3 of said coupler 80 differ in phase by 45 degrees. A discussion of such a class of directional coupler is found in "General Synthesis of Asymmetric Multi-Element Coupled-Transmission-Line Directional Couplers" by Ralph Levy, IEEE Transactions—Vol. MTT-11, No. 4, July 1963, pp 226–237 and also in "Practical Strip-Line Microwave Circuit Design" by George L. Millican and Robert C. Wales, IEEE Transactions, Vol. MTT-17, No. 9, September 1969, pp 696–705.

Power divider network 1 (PDN1) 84 and power divider network 2 (PND2) 86 are lossless power dividers which divide an input signal at port X (or port Y) into N1 (or N2) mutually isolated outputs all in the same phase and with powers in the binary ratio 1,2,4, . . . $2^{N-1}$. Each of the outputs of PND1 84 and PDN2 86 are terminated in similar switches all of which independently can have two states only, open or closed, which produce total reflection with phases that differ by 180 degrees.

The reflection coefficients produced at point X by PND1 84 for all possible state combinations of the switches attached to it will take on $2^{N1}$ values equally spaced between $\pm 1$. Similarly at point Y, PDN2 86 will produce $2^{N2}$ values equally spaced between $\pm 1$. These reflections at points X and Y produced by PDN1 84 and PDN2 86 will result in simultaneous quadrature reflections at the input port 1 of directional coupler 80 and also simultaneous quadrature signals at the output port 4 of said coupler. The total signal reflected at port 1 of directional coupler 80 and that transmitted from port 1 of directional coupler 80 to port 4 of said coupler are the vector sums of those produced (at ports 1 and 4 of directional coupler 80) by PDN1 84 and PDN2 86.

Figure 5:
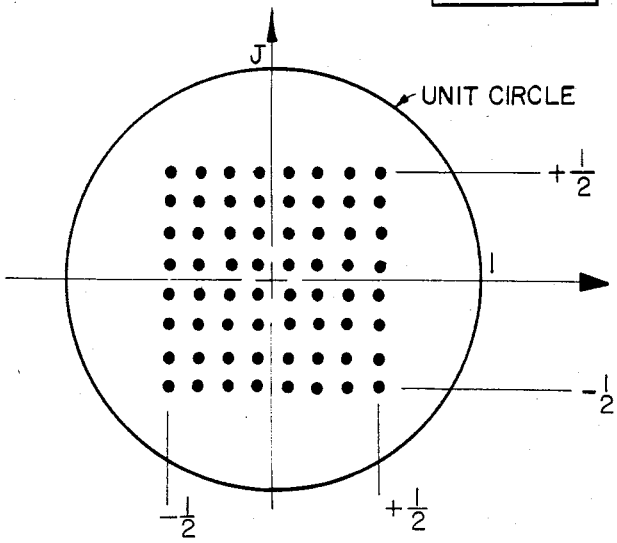
FIG. 5 is a polar diagram of the reflection coefficients at input port A of the invention's preferred embodiments as shown in FIG. 1 when port H is terminated in its characteristic impedance, and also it represents the transmission characteristics between port A and port H.

In the preferred embodiment as shown in FIG. 1, directional coupler 80 of FIG. 4 has a coupling value of 3 dB, giving equal power division of an input signal at port 1 to ports 2 and 3. Consequently, the reflection magnitude at port 1 of said coupler is equally sensitive to reflections presented to its output ports 2 and 3. The preferred embodiment also requires PDN1 84 and PDN2 86 to be identical, each with three outputs with a power ratio 1:2:4. In the preferred case where directional coupler 80 has 3 dB coupling and the total number of switches is six, the $2^6$ states of both PDN1 84 and PDN2 86 together will produce sixty-four reflection coefficients at port 1 of directional coupler 80 equally spaced in a square bounded by $\pm\frac{1}{2}$, $(\pm\frac{1}{2})j$ in the reflection coefficient plane, as shown in FIG. 5. Similarly, the transmission coefficients between ports 1 and 4 of directional coupler 80 can be represented by sixty-four uniformly distributed points in the transmission coefficient plane bounded by the lines $\pm\frac{1}{2}$ and $(\pm\frac{1}{2})j$. In the general case, where the coupling factor of a directional coupler 80 is other than 3 dB, the patterns produced will be bounded by a rectangle whose sides are determined by the coupling coefficient of the directional coupler. In all cases the perimeter of the rectangular boundary will be four units in length. In the general case it may be preferred to use different dividers for PDN1 84 and PDN2 86 to produce equally-spaced points in both directions within the rectangular boundary.

This concludes the description of the preferred embodiment. However, many modifications and alterations will be obvious to one of ordinary skill in the art without departing from the spirit and scope of the inventive concept. For example, the switches may be implemented with PIN diodes or also with gas switches or solenoid operating switches; RF transmission lines may be implemented with stripline, microstrip, coaxial or waveguides; and the directional couplers may be of the types with quadrature, equal or opposite phased outputs. Therefore, it is intended that the scope of this invention be limited only by the appended claims.

What is claimed is:

1. An adjustable two-port network for generating a discrete number of reflection and transmission coefficients comprising:

a four-port reciprocal coupling means for dividing an input signal into two isolated output signals;

means for providing a phase shift to a first one of said output signals;

means coupled to a second one of said output signals and said phase shift means for producing in response to a control signal a selected one of a plurality of reflections comprising different discrete amplitudes with similar phase, thereby producing said discrete number of reflection and transmission coefficients of said two-port network; and digital controller means for generating said control signal, thereby selecting any one of said discrete number of reflection and transmission coefficients.

2. The network as recited in claim 1 wherein:

said reciprocal coupling means comprises a 3 dB directional coupler.

3. The network as recited in claim 1 wherein:

said producing means of a plurality of reflections comprises a plurality of directional couplers.

4. The network as recited in claim 3 wherein:

said producing means further comprises a plurality of switches.

5. The network as recited in claim 1 wherein:

said digital controller means comprises a programmable digital controller.

6. An adjustable impedance load comprising:

reciprocal coupling means for dividing an input signal into two isolated output signals;

means for providing a phase shift to a first one of said output signals;

means coupled to a second one of said output signals and said phase shift means for producing in response to a control signal a selected one of a plurality of reflections comprising different discrete amplitudes with similar phase, thereby producing one of a discrete number of load impedances at the input to said reciprocal coupling means;

digital controller means for generating said control signal, thereby selecting one of said load impedances.

7. The adjustable impedance load as recited in claim 6 wherein:

said reciprocal coupling means comprises a directional coupler having a terminating load on an isolated port of said reciprocal coupling means.

8. The adjustable impedance load as recited in claim 6 wherein:

said producing means of a plurality of reflections comprises a plurality of directional couplers.

9. The adjustable impedance load as recited in claim 8 wherein:

said producing means further comprises a plurality of switches.

10. The adjustable impedance load as recited in claim 6 wherein:

said digital controller means comprises a programmable digital controller.

11. An adjustable two-port network for generating a plurality of reflection and transmission coefficients comprising:

a four-port reciprocal coupling means for dividing an input signal into two isolated output signals;

means coupled to a first one of said isolated output signals for producing a specific phase difference between said isolated output signals;

first network means coupled to a second one of said isolated output signals of said reciprocal coupling means for producing in response to a control signal a selected one of a plurality of reflections of different discrete amplitudes with similar phase, thereby producing signals at both ports of said two-port network;

second network means coupled to said phase difference producing means for producing in response to said control signal said selected one of a plurality of reflections of different discrete amplitudes with similar phase, thereby producing signals at both ports of said two-port network; and digital controller means for generating said control signal, thereby selecting one of said plurality of reflection and transmission coefficients of said two-port network.

12. The network as recited in claim 11 wherein:

said reciprocal coupling means comprises a 3 dB directional coupler.

13. The network as recited in claim 11 wherein:

said means for producing said phase difference causes the reflections at the input port of said coupling means, produced by said first network means, to differ by 90° from the reflections produced by said second network means, at said input port of said coupling means.

14. The network as recited in claim 11 wherein:

said means for producing said phase difference causes signals from an isolated port of said reciprocal coupling means produced by said first and second network means to be in phase quadrature.

15. The network as recited in claim 11 wherein:

said first network means comprises a power divider with a plurality of mutually isolated outputs.

16. The network as recited in claim 15 wherein:

said power divider comprises at least one directional coupler.

17. The network as recited in claim 11 wherein:

said second network means comprises a power divider with a plurality of mutually isolated outputs.

18. The network as recited in claim 17 wherein:

said power divider comprises at least one directional coupler.

19. The network as recited in claim 11 wherein:

said first and second network means comprise a switch at each of their outputs for providing an open or short circuit.

20. The network as recited in claim 19 wherein:

each of said switches are independently controllable and produce total reflections with phases that differ by 180° for each of said two-state switches.

21. An adjustable load having a plurality of discrete impedances comprising:

reciprocal coupling means for dividing an input signal into two isolated output signals;

first network means for producing in response to a control signal a selected first one of a plurality of reflections of different discrete amplitudes with similar phase at an input port of said coupling means;

second network means for producing in response to said control signal a selected second one of a plurality of reflections of different discrete amplitudes with similar phase at the input port of said coupling means;

means for providing a phase difference between said reflections at the input port of said coupling means produced by said first network means and said second network means; and digital controller means for generating said control signal, thereby selecting one of said plurality of discrete impedances.

22. The adjustable load as recited in claim 21 wherein:

said reciprocal coupling means comprises a directional coupler having a terminating load on an isolated port of said reciprocal coupling means.

23. The adjustable load as recited in claim 21 wherein:

said means for producing said phase difference causes the reflections at the input port of said coupling means, produced by said first network means, to differ by 90° from the reflections produced by said second network means, at said input port of said coupling means.

24. The adjustable load as recited in claim 21 wherein:

said first network means comprises a power divider with a plurality of mutually isolated outputs.

25. The adjustable load as recited in claim 24 wherein:

said power divider comprises at least one directional coupler.

26. The adjustable load as recited in claim 21 wherein:

said second network means comprises a power divider with a plurality of mutually isolated outputs.

27. The adjustable load as recited in claim 26 wherein:

said power divider comprises at least one directional coupler.

28. The adjustable load as recited in claim 21 wherein:

said first and second network means comprise a switch at each of their outputs for providing an open or short circuit.

29. The adjustable load as recited in claim 28 wherein:

each of said switches are independently controllable and produce total reflection with phases that differ by 180° for each of said two-state switches.

30. In combination:

first reciprocal coupling means for dividing an input signal into an output signal and a coupled signal which are isolated from each other;

means for providing a phase shift to said coupled signal from said first reciprocal coupling means;

second reciprocal coupling means responsive to said output signal from said first coupling means for dividing said signal into 1/7 and 6/7 power output segments;

said 1/7 power output segment from the coupled port of said second reciprocal coupling means connecting to a first delay and the output of said delay connecting to a first two-state switch;

third reciprocal coupling means responsive to said 6/7 power output segment from the output port of said second reciprocal coupling means for dividing said signal into $\frac{1}{3}$ and $\frac{2}{3}$ power output segments;

said $\frac{1}{3}$ power output segment from said third coupling means connecting to a second delay and the output of said delay connecting to a second two-state switch;

said $\frac{2}{3}$ power output segment from said third coupling means connecting to a third two-state switch;

fourth reciprocal coupling means responsive to the output of said phase shift means for dividing said signal into 1/7 and 6/7 power output segments;

said 1/7 power output segment from the coupled port of said fourth reciprocal coupling means connecting to a third delay and the output of said delay connecting to a fourth two-state switch;

fifth reciprocal coupling means responsive to said 6/7 power output segment signal from the output port of said fourth reciprocal coupling means for dividing said signal into $\frac{1}{3}$ and $\frac{2}{3}$ power output segments;

said $\frac{1}{3}$ power output segment from said fifth coupling means connecting to a fourth delay and the output of said delay connecting to a fifth two-state switch;

said $\frac{2}{3}$ power output segment from said fifth coupling means connecting to a sixth two-state switch; and digital controller means connected to each of said switches for generating a control signal for selecting the state of said two-state switches.

31. The combination as recited in claim 30 wherein:

said first reciprocal coupling means comprises a 3 dB directional coupler.

32. The combination as recited in claim 30 wherein:

said second and fourth reciprocal coupling means each comprise an 8.45 dB directional coupler.

33. The combination as recited in claim 30 wherein:

said third and fifth reciprocal coupling means each comprise a 4.77 dB directional coupler.

34. The combination as recited in claim 30 wherein:

said switches comprise PIN diodes.

35. The combination as recited in claim 30 wherein:

the isolated port of each of said reciprocal coupling means is terminated in its characteristic impedance.

36. The combination as recited in claim 30 wherein:

said first and second delays provide equivalent electrical lengths from an input of said second coupling means to said first, second and third switches.

37. The combination as recited in claim 30 wherein:

said third and fourth delays provide equivalent electrical lengths from an input of said fourth coupling means to said fourth, fifth and sixth switches.

38. The combination as recited in claim 30 wherein:

said digital controller means comprises programmable digital means.

39. The method of generating a plurality of reflection and transmission coefficients of a two-port network comprising the steps of:

dividing an input signal into two isolated output signals with a four-port reciprocal coupling means;

providing a phase difference between said isolated output signals with a phase shifter coupled to a first one of said isolated output signals;

producing in response to a control signal a selected first one of a plurality of reflections of different discrete amplitudes with similar phase, thereby producing signals at both ports of said two-port network with a first network means coupled to a second one of said isolated output signals;

producing in response to said control signal a selected second one of a plurality of reflections of different discrete amplitudes with similar phase, thereby producing signals at both ports of said two-port network with a second network means coupled to said phase shifter; and;

generating said control signal with digital controller means for selecting one of said plurality of reflection and transmission coefficients of said two-port network.

40. The method as recited in claim 39 wherein:

the step of dividing an input signal into two isolated output signals comprises a 3 dB directional coupler.

41. The method as recited in claim 39 wherein:

the step of providing said phase difference comprises making the reflections at the input port of said coupling means, produced by said first network means, differ by 90° from said reflections produced by said second network means at said input port of said coupling means.

42. The method as recited in claim 39 wherein:

the step of providing said phase difference causes signals from an isolated port of said reciprocal coupling means produced by said first and second network means to be in phase quadrature.

43. The method as recited in claim 39 wherein:

said step of producing reflections of different discrete amplitudes with said first network means comprises using a power divider with a plurality of mutually isolated outputs.

44. The method as recited in claim 39 wherein:

said step of producing reflections of different discrete amplitudes with said second network means comprises using a power divider with a plurality of mutually isolated outputs.

45. The method as recited in claim 39 wherein:

said first and second network means comprise a two-state switch at each of their outputs.

46. The method of generating a plurality of discrete impedances with a microwave network comprising the steps of:

dividing an input signal into two isolated output signals with a reciprocal coupling means;

producing in response to a control signal a selected first one of a plurality of reflections of different discrete amplitudes with similar phase at an input port of said coupling means;

producing in response to said control signal a selected second one of a plurality of reflections of different discrete amplitudes with similar phase at the input port of said coupling means;

providing a phase difference between said first and second reflections at the input port of said coupling means; and generating said control signal with digital controller means, thereby selecting one of said plurality of discrete impedances generated by said plurality of reflections.

47. The method as recited in claim 46 wherein:

the step of dividing an input signal with said reciprocal coupling means comprises a terminating load on an isolated part of said reciprocal coupling means.

48. A microwave network comprising:

a pair of power divider networks each one coupling a microwave signal fed thereto to a plurality of signal paths, each path having one of a plurality of selectable terminating impedances, each power divider network having one of a plurality of reflection coefficients in accordance with said selected terminating impedances of the plurality of signal paths; and means for coupling an input microwave signal fed to an input port of the microwave network to each of the pair of power divider networks, said input port having one of a plurality of reflection coefficients produced in response to the selected reflection coefficients of the pair of power divider networks, said plurality of selectable input port reflection coefficients being complex reflection coefficients.

49. The microwave network as recited in claim 48 wherein:

each of said power divider networks couples a different amount of energy of the microwave signal fed thereto to each of the plurality of signal paths in said networks.

50. The microwave network as recited in claim 49 wherein:

said one of the plurality of selectable terminating impedances is either an open circuit impedance or a short circuit impedance.

51. The microwave network as recited in claim 48 wherein:

each of said power divider networks reflects a selectable portion of energy fed thereto to an input of said power divider networks through the plurality of signal paths, said selectable portion of said energy comprises a plurality of reflected signals passing through said plurality of signal paths, said reflected signals having the same or opposite phases.

* * * * *